US005921944A

United States Patent [19]

Borodulin et al.

[11] Patent Number: 5,921,944

[45] Date of Patent: Jul. 13, 1999

[54] VIBRATORY DEVICE FOR TREATING VOIDING DYSFUNCTION

[76] Inventors: German Borodulin, 583-46th Ave., San Francisco, Calif. 94121; Alexander Shkolnik, 485 Dartmouth Ave., San Carlos, Calif. 94070; Maxim Persidsky, 35 Temescal, San Francisco, Calif. 94118

[21] Appl. No.: 09/008,441

[22] Filed: Jan. 16, 1998

[51] Int. Cl.[6] ..... A61H 1/00

[52] U.S. Cl. ..... 601/83; 601/101; 604/109; 606/191

[58] Field of Search ..... 601/83, 80, 81, 601/101, 103, 155; 604/107, 108, 109, 22, 106; 606/191, 198, 205

[56] References Cited

U.S. PATENT DOCUMENTS 4,773,400 9/1988 Borodulin et al. .
5,081,985 1/1992 Borodulin et al. .

*Primary Examiner*—Richard J. Apley
*Assistant Examiner*—Justine R. Yu

[57] ABSTRACT

A vibratory device (20) for treating female voiding dysfunctions, such as urinary stress incontinence, by inserting it into a patient's urinary tract and imparting vibrations to the urethral walls and the bladder neck. The device is made in the form of a urological bougie (23) which has a distal end and a proximal end and consists of two resilient rods (26 and 28). The rods are removably interconnected at their distal ends by means of two short extensions (52*a* and 52*b*) which are inserted into a cup-shaped cavity (68). This cavity is formed at the end of a cam (66). The cam has an elliptical or oval shape and is driven into rotation from a rotary drive unit (24) through a cam shaft (64) which passes through the hole formed by grooves (54) on the mating surface of the rods. Due to the elliptical configuration of the cam, its rotation causes expansion of the rods (26 and 28). The rods, however, cannot be disconnected during the operation, as their projections (52*a* and 52*b*) are confined within the cup-shaped cavity. The probe is covered by a rubber condom-like shell (30) which protects the mucosa of the patient's urethra from pinching. At the same time the outer shell prevents leaking of the urine from the patient's bladder during the treatment procedure. With the shell the vibratory treatment can be carried out with the bladder being filled. In this case vibration can be transmitted to the detrusor muscles, i.e., to the bladder walls. As a result, the vibratory treatment can be more efficiently used.

14 Claims, 2 Drawing Sheets

VIBRATORY DEVICE FOR TREATING VOIDING DYSFUNCTION

This invention is a modification of the expandable urethral bougie disclosed in U.S. Pat. No. 4,773,400, issued on Sep. 27, 1988.

BACKGROUND

1. Field of the Invention

The present invention relates to medical instruments, particularly to a vibratory device for treating female voiding dysfunctions associated with functional and organic changes in the urethra and bladder neck.

2. Description of Prior Art

Most often met form of voiding dysfunctions is urinary incontinence. According to data from the January 1991 issue of "Lovett Underwood Neuhause & Webb", over 10 million Americans, i.e. 4 percent of the U.S. adult population alone suffer from some form of urinary incontinence. The economic impact of urinary incontinence is enormous and is likely to rise as the number of elderly in the population increases. In accordance with data from the Journal of Urology, April 1988, urinary incontinence in the elderly is a major social problem. The annual cost of incontinence care in the U.S. alone currently exceeds $10 billion.

One of the most frequent type of urinary incontinence is the so-called stress urinary incontinence, which is defined as the involuntary loss of urine through the intact urethra as the result of a sudden increase in intra-abdominal pressure in the absence of bladder activity. Stress urinary incontinence accounts for roughly 75% of all female urinary incontinence. The most common cause of stress urinary incontinence in female is malfunction of the sphincteric mechanism of the bladder and an inadequate reaction of pelvic floor muscles.

Urinary incontinence is difficult to treat. Treatment of urinary incontinence falls in to three main categories: (1) surgery; (2) drug therapy; (3) reeducation, including bladder retraining programs and reeducation of the pelvic floor muscles. The existing urinary incontinence treatment methods and instruments, however, are far from being completely successful, and despite long-term and repeated course of treatment, recurrences are not uncommon.

Treatment of patients by means of mechanical vibration induced by specially designed vibratory instruments is established therapeutic method and has been known since nearly century. Short-term localized vibration has been noted to intensify blood circulation, increases assimilation of oxygen by tissue, and alters the activity of some enzymes. Therefore the vibration affects directivity of metabolic processes.

Low-frequency (10–200 Hz) vibratory stimulation as a form of therapy has been successfully used in variety of disorders to improve muscle contractivity, reduce spasticity and decrease inflammation.

Different frequencies and amplitudes of vibratory stimulation may exert their influence on contraction/reflection of muscles.

Based on information about the therapeutic effect of vibratory stimulation, one can anticipate that the use of endourethral dosed vibratory stimulation (massage) should be a very effective procedure in the treatment of patients suffering from different types of voiding dysfunctions.

The authors have developed a series of vibratory mechanically expandable urethral bougies for treating female voiding dysfunctions. One such instrument is disclosed in U.S. Pat. No. 4,773,400, issued Sep. 27, 1988 to G. Borodulin, et al. According to one of the embodiments of that invention, the bougie comprises a rotary drive unit, a probe consisting of two resilient rods with the front ends of the rods being permanently pivotally connected to each other and opposite ends being fixed in the housing of the drive unit, and a rotary elliptical or oval-shaped cam between the above-mentioned rods, the cam being connected to the output element of the drive unit, so that rotation of the cam causes periodic expansions and contractions of the resilient rods. When the probe is inserted into the urethra of a patient suffering from a voiding dysfunction, the patient's urethra is subjected to massaging vibratory action which is extremely efficient for treating diseases of the urethra and the neck of the urinary bladder. In order to prevent pinching of mucosa of the urethra walls, the edges of the rods on their mating surfaces are chamfered.

Although the instrument described above is quite efficient in its action, permanent pivotal connection of the front ends of the rod does not allow disconnection of the rods. This creates inconveniences in cleaning.

Besides, the contraction of the rods depends only on resilient properties of the rods themselves, i.e., there is no positive means for returning the rods into the contracted state. After many repeated cycles of expansion and contraction, the material of the rods may change or partially lose its resiliency whereby vibratory treatment conditions and radial expansion forces applied to the urethral walls also may change. This, in turn, will change the vibratory treatment conditions.

Although chamfers on the edges of the rods protects the urethral wall mucosa from pinching, they reduce the contracting areas of the rods which increases the pressure on the unit surface of the contacting area. Furthermore, the chamfers are not always sufficient for protecting the mucosa from pinching.

If the probe is inserted into the urethra and enters the patient's bladder when the bladder is not preliminary emptied, during the treatment the urine may flow out from the bladder through the split-type probe to the outside. This will create inconveniences both for the patient and for the urologist. If, however, the bladder is not filled, it is difficult to transmit the vibratory forces to the bladder detrusor muscles, i.e., to the walls of the bladder.

OBJECTS AND ADVANTAGES OF THE INVENTION

It is therefore an object of the invention to eliminate the above disadvantages and to provide a simple, reliable, and efficient vibratory device for treating voiding dysfunctions which is suitable for treating a patient with the patient's bladder being filled, has positive means for contracting the rods of the probe, prevents urine from flowing out from the patient's bladder during the vibratory treatment, and has disconnectable probe rods convenient for cleaning. Other objects and advantages of the invention will become apparent after the consideration of the ensuing description with the accompanying drawings.

DETAILED DESCRIPTION OF THE VIBRATORY DEVICE OF THE INVENTION

Figure 1:
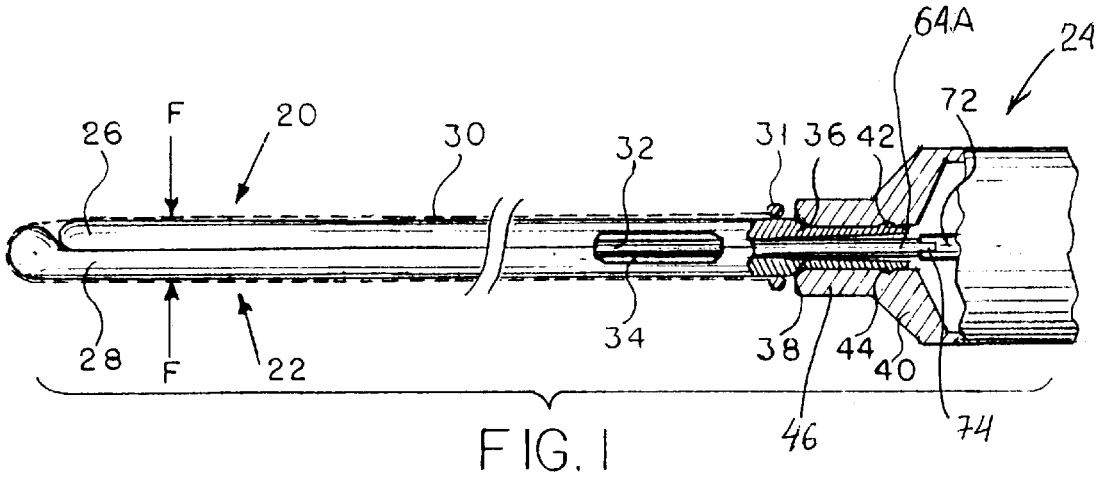
FIG. 1 is a general, partially sectional view of a vibratory device of the invention for treating female voiding dysfunctions.

FIG. 1 is a general view of a vibratory device of the invention for treating female voiding dysfunctions (hereinafter referred to simply as a vibratory device). The vibratory device in general is designated by reference numeral 20.

Vibratory device 20 consists of an expandable and contractible probe 22 and a rotary drive unit 24.

In the preferred embodiment, probe 22 is 7–8 mm in diameter and has a length of 20–25 cm. Probe consists of a first and second straight flexible rods 26 and 28, respectively. From the outside, probe 22 is covered, entirely or at least on a substantial part of its distal end insertable into the patient's urethra by a resilient outer shell 30. Outer shell 30 may comprise a thin-film condom-like cover tightly fitted onto the probe so that it develops contracting forces F (FIG. 1) tending to hold rods 24 and 26 in a contracted state (FIGS. 1, 2, 6, and 8). Although outer shell 30 may be removable for disassembling and cleaning of the rods, in the case of a disposable probe the proximal end of outer shell 30 may be rigidly attached, e.g., by thermal welding at 31, to the outer surfaces of the rod, so that the entire probe is sealed inside the shell.

Figure 6:
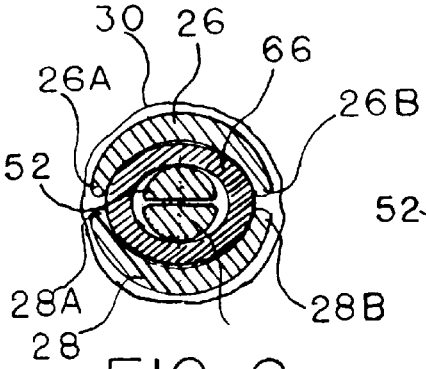
FIG. 6 is a cross-sectional view along line VI—VI of FIG. 2.

As shown in FIG. 1, one of the rods, e.g., rod 26, is shorter than the other, i.e., rod 28. It is preferable, however, that the mating distal ends of both rods conform to one another as shown in FIG. 1, so that the probe have a streamline external configuration. For better flexibility, rods 26 and 28 may have cutouts 32 and 34. Except for their length, the remaining parts of the rods are identical. Although the mucosa of the patient's urethra would be protected from pinching by outer shell 30, for additional protection rods 26 and 28 may have on their longitudinal edges chamfers 26*a*, 26*b*, and 28*a*, 28*b*(FIG 6).

Rods 26 and 28 have flat shank portions 36 and 38, respectively, which are insertable into the front end of a drive unit housing 40. The shank portions can be fixed in housing 40 by any conventional means, e.g., by snapping projections 42 and 44 in respective recesses of a hub 46 in the front portion of housing 40. The distal ends of rods 26 and 28 are removably interconnected by a special coupling 48 which allows a limited radial movement of the rods in a radial outward direction, but positively prevents them from complete separation.

Now the construction of each of the rods and coupling 48 will be described with reference to FIGS. 2, 3, 5, and 6.

Figure 2:
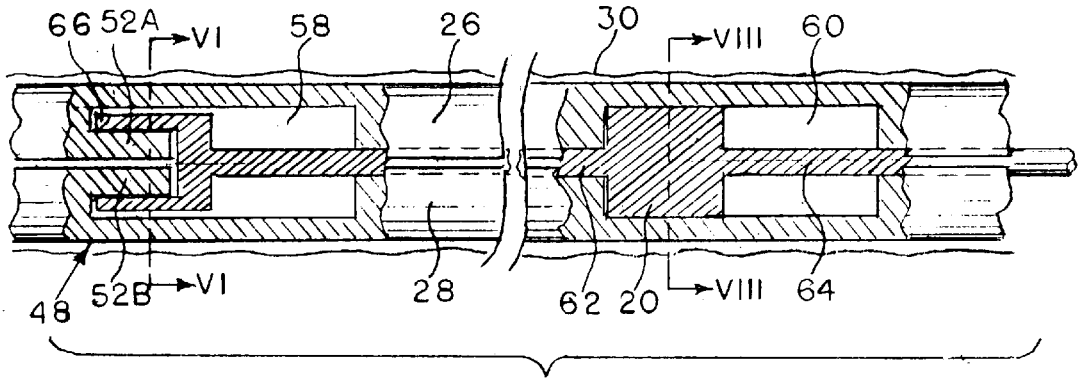
FIG. 2. is a longitudinal sectional view of a part of a probe used in the device of FIG. 1, rods of the probe being shown in a contracted position.

FIG. 2 is a longitudinal sectional view of a part of probe 22, rods 26 and 28 of the probe being shown in a contracted state.

Figure 3:
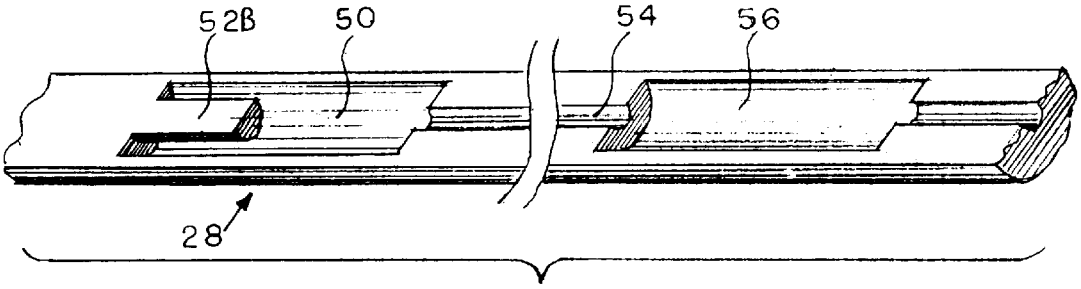
FIG. 3 is a perspective view on a part of one of the probe rods.
Figure 4:
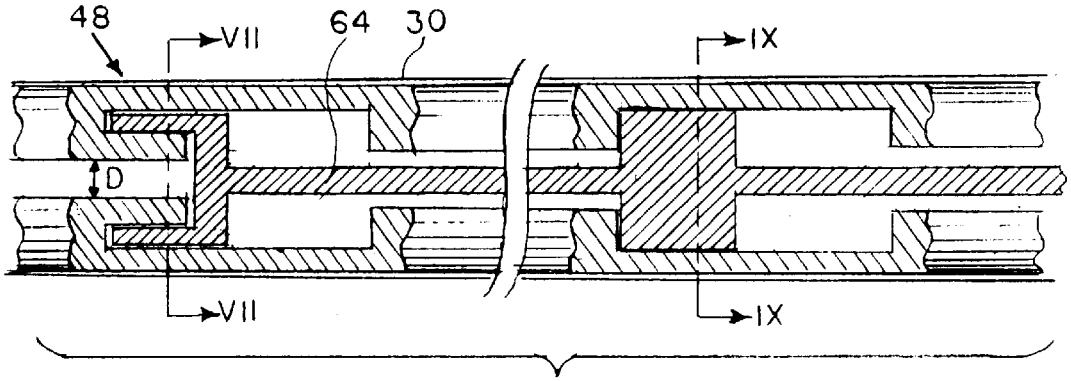
FIG. 4 is a fragmentary longitudinal sectional view of the probe of FIG. 2 with the rods in the expanded position.
Figure 5:
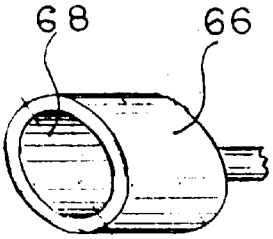
FIG. 5 is a perspective view of a cup-shaped elliptical cam of the probe of FIG. 2.

FIG. 3 is a perspective view on a part of one of the probe rods,

FIG. 4 is a fragmentary longitudinal sectional view of the probe of FIG. 2 with the rods in the expanded position, FIG. 5 is a perspective view of a cup-shaped elliptical cam of the probe of FIG. 2, and FIG. 6 is a cross-sectional view along line VI—VI of FIG. 2.

As shown in the above drawings, except for shank portions 36 and 38, rods 26 and 28 have semicircular cross-sections. Each rod has at least one semielliptical recess 50 with a short inward projection 52*a* or 52*b* which is directed from the distal end toward the proximal end. As shown in FIG. 3, projection 52*b* has a semicircular cross-section. A central longitudinal groove 54 passes through the entire rod from recess 50 to the proximal end of the rod. Groove 54 also has a semicircular cross-section. If necessary, one or more additional recesses, such as a recess 56, may be formed in each rod.

In an assembled state of the probe, semielliptical recesses 50 and 56 of both rods 26 and 28 form complete elliptical cavities 58 and 60(FIG 2), respectively. Grooves 54 form a complete round through hole 62 which passes through both cavities 58 and 60 and extends to the proximal end of probe 22.

Figure 7:
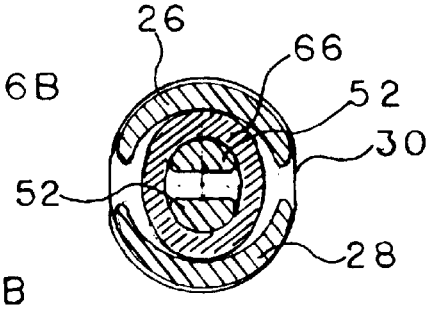
FIG. 7 is a cross-sectional view along line VII—VII of FIG. 4.

Inserted into probe 22 is a cam shaft 64, the configuration of which is shown FIG. 2. As can be seen from this drawing, at its distal end shaft 64 has a cup-shaped elliptical cam 66. The cam has substantially the same configuration and outer dimensions as elliptical cavity 58. The open end of cam 66 faces projections 52*a* and 52*b*. In an assembled state of the probe, cam 66 is located in elliptical cavity 58. Projections 52*a* and 52*b* are inserted into an elliptical hole 68 of cup-shaped cam 66 so that the inner walls of this hole limit an outward radial movement of projections 52*a* and 52*b* and thus protect rods 26 and 28 from separation. Elliptical configuration of hole 68 (FIG. 5) is concentric to outer configuration of elliptical cam 66 (FIG. 6). Elliptical cavity 58 (FIG. 2) formed. by recesses 50 of each rod has the same maximum and minimum radii of the ellipse as the respective radii of cam 66, so that when cam shaft 64 rotates together with its cam 66, rods 26 and 28 are moved apart to the maximum distance each time cam 66 assumes a position shown in FIG. 7, i.e., the position in which the cam contacts the rods in the points of its maximum radius. FIG. 7 is a cross-sectional view along line VII—VII of FIG. 4. In FIG. 7 cam 66 is turned by 90° from the position of FIG. 6. When cam 66 continues its rotation, rods 26 and 28 are positively return to their initial position under the effect of inner walls of cam 66, resilient forces of the rods, and resilient outer shell 30. For positively returning the rods into their contracted position, elliptical hole 68 should have the minimum radius of the ellipse substantially equal or only slightly greater than the radius of each projection 52*a* and 52*b*.

Apart from the function of positively returning the rods into their contracted state, both projections 52*a* and 52*b* comprise means for removably interconnecting rods 26 and 28. Cavity 58 has an axial length greater than the axial length of cam 66, at least by a depth of insertion of projections 52*a* and 52*b* into hole 68. When the probe is disconnected from drive unit 24, cam shaft 64 is shifted rearward for a distance exceeding the depth of insertion of projections 52*a* and 52*b* into hole 68. This action disconnects the projections from hole 68, so that rods 26 and 28 can be disconnected from each other, e.g., for cleaning purposes or replacement.

In order to provide more uniform expansion and contraction, cam shaft 64 may have a second elliptical cam 70 which is located in second elliptical recess 60. Both cams 66 and 70 may have identical outer dimensions with the only difference that cam 70 is solid. If necessary, cavity 60 and cam 70 may have dimensions and configurations different from those of cavity 58 and cam 66.

Figure 8:
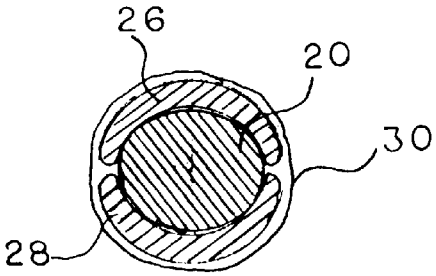
FIG. 8 is a cross-sectional view along line VIII—VIII of FIG. 2.
Figure 9:
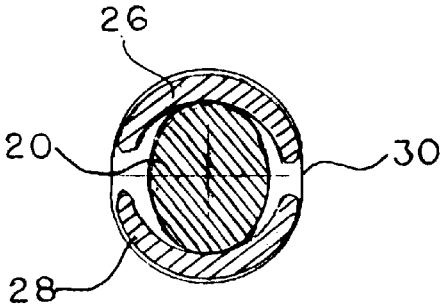
FIG. 9 is a cross-sectional view along line IX—IX of FIG. 4.

While FIGS. 2, 6, and 8 show position of parts of the probe in its contracted state, FIGS. 4, 7, and 9 show position of the same parts in the expanded state of the probe. FIG. 8 is a cross-sectional view along line VIII—VIII of FIG. 2, and FIG. 9 is a cross-sectional view along line IX—IX of FIG. 4.

A proximate end 64*a* of cam shaft 64 is drivingly connected to an output shaft 72 of drive unit 24, e.g., through a pin-and-slot connection 74, so that rotation of output shaft 72 is transmitted to shaft 64 and hence to cam 66.

The entire probe, including rods and shaft may be made of stainless steel. In the case the probe is disposable, all its parts can be made of plastic.

Figure 10:
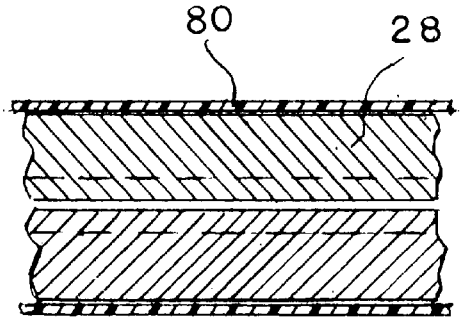
FIG. 10 is a fragmentary longitudinal sectional view of a probe with a resilient outer shell in the form of a coating film applied onto the surface of the probe.

If necessary, in a disposable version of the probe an outer shell 76 may be permanently applied onto the surface of the probe. FIG. 10 is a fragmentary longitudinal sectional view of a probe 78 with a resilient outer shell 80 in the form of a coating film applied onto the surface of the probe, e.g., by spraying. In order to allow expansion of the probe, the outer shell material should possess high elasticity and sufficient strength. Such a material may comprise a rubber.

OPERATION

If probe 22 is not integral with resilient outer shell 30, prior to operation, a urologist covers probe 22 with a resilient outer shell 30, and then inserts probe 22 into the patient's urethra (not shown) in accordance with a specified procedure. The procedure begins with the introduction into the urethra of a special gel for lubrication and anesthesia. As the treatment procedure is beyond the scope of the present invention, its particularities will be omitted.

When the urologist switches on drive unit 24, its output shaft 72 begins to rotate and transmits its rotation through pin-and-slot connection 74 to cam shaft 64. As cam shaft 64 rotates, its elliptical cams 66 and 70 also rotate. When during the rotation, cams 66 and 70 are in positions shown in FIGS. 7 and 9, respectively, rods 26 and 28 are moved apart radially outwardly for a distance "D" shown in FIG. 4. In fact, distance D is a difference between the maximum diameter of hole of 68 and the diameter of the circle formed by two projections 52*a* and 52*b*. Radial outward movement of projections 52*a* and 52*b* is limited by the inner walls of cavity 68 of cam 66. The rods are expanded against their contraction resilient forces and the contracting force of outer shell 30, so that when the cams are turned by 90° from the positions of FIGS. 7 and 9, the forces developed by the inner walls of cavity 68 and the above-mentioned resilient forces of the rods and outer shell will return them into positions shown in FIGS. 2, 7, and 9.

Thus cup-shaped cam cavity 68 not only provide contraction of the rods and prevents them from further expansion, but also keeps the probe in an assembled state and protects rods 26 and 28 from occasional disconnection.

During the operation, external shell 30 (as well as resilient coating 80) fulfils several functions, i.e., it protects the mucosa of the urethra (not shown) from pinching, provides an additional contracting force for closing the expanded rods, and prevents leakage of the urine from the patient's bladder. This allows the urologist to use vibratory instrument in a patient with a filled bladder. When the bladder is filled, the vibratory forces developed by the vibrating rods may be better transmitted to the detrusor muscles, i.e., to the bladder walls. This ensures efficient treatment of the bladder. Thus, external shell comprises a combined means for protecting the patient's mucosa from pinching, for preventing the leakage of urine from the patient's bladder, and for enhancing the contraction of rods.

SUMMARY, RAMIFICATIONS, SCOPE

It has been shown that the invention provides a simple, reliable and efficient vibratory device for treating female voiding dysfunctions which is suitable for treating the patient with the patient's bladder being filled, has positive means for contracting the rods of the probe, prevents urine from flowing out from the patient's bladder during the vibratory treatment, and has disconnectable probe rods convenient for cleaning. Other objects and advantages of the invention will become apparent after the consideration of the ensuing description with the accompanying drawings.

Although the vibratory device has been shown and described in the form of a specific embodiment, this embodiment, its parts, materials, and configurations have been given only as examples, and that many other modifications of the vibratory bougie possible. For example, probe 22 may have more than two cams. The cams may have cross-sections other than elliptical, e.g., oval, or the like. Drive unit may have an electrical motor supplied from batteries or from a conventional electric power supply line. The drive may be from a motor through a flexible shaft.

The probes may have different lengths, smaller diameters, and a curved configuration for treating male voiding dysfunctions, or the probe may have a larger diameter for treating anal sphincteric dysfunctions.

Therefore, the scope of the invention should be determined, not by the example given, but by the appended claims an their legal equivalents.

What we claim is:

1. A vibratory device for treating voiding dysfunctions by inserting it into a patient's urinary tract and imparting vibrations to the urethral walls and the bladder neck, comprising:

a probe which has a distal end and a proximal end and consists of at least a first resilient rod and a second resilient rod, said rods being removably jointed at their distal ends;

a rotary drive having a housing and an output rotary shaft;

rotary camming means for positively expanding and contracting said rods radially outwardly and inwardly, respectively, from each other when said rotary means rotate, said rotary camming means being connected to said output rotary shaft of said drive means and are driven into rotation from said drive means;

means for protecting the mucosa of the patient's urethra from pinching, for preventing the leakage of urine from the patient's bladder, and for enhancing the contraction of said rods after expansion;

each of said rods having at least one cavity which in an assembled state of the probe has a symmetrical configuration and location with respect to a mating cavity of said second rod, so that in an assembled state of said probe both said cavities form an essentially closed cavity, said rotary camming means comprising a cam shaft with at least one cam having an outer surface with a maximum radius and a minimum radius and located in said closed cavity, said cam having a hole open towards said distal end of said probe, said hole having a maximum radius and a minimum radius, said rods having projections of semicircular cross section inserted into said hole, a radius of each of said semicircular projections being substantially equal to said minimum radius of said hole, so that when said cam rotates, said outer surface forces said rods to expand on a part of the revolution of said cam, while said hole forces said rods to contract on the remaining part of the revolution of said cam, said essentially closed cavity having an axial length greater than an axial length of said cam at least by a depth of insertion of said projections into said hole;

said means for protecting the mucosa of the patient's urethra from pinching, for preventing the leakage of urine from the patient's bladder, and for enhancing the contraction of said rods after expansion comprising an outer shell of an elastic material which covers at least that part of said probe which is inserted into the patient's urethra.

2. The vibratory device of claim 1 wherein said outer shell of an elastic material is made of a rubber film.

3. A vibratory device for treating voiding dysfunctions by inserting it into a patient's urinary tract and imparting vibrations to the urethral walls and the bladder neck, comprising:

a probe which has a distal end and a proximal end and consists of at least a first resilient rod and a second resilient rod, said rods being removably jointed at their distal ends;

a rotary drive having a housing and an output rotary shaft;

rotary camming means for positively expanding and contracting said rods radially outwardly and inwardly, respectively, from each other when said rotary camming means rotate, said rotary camming means being connected to said output rotary shaft of said drive means and is driven into rotation from said drive means; and means for protecting the mucosa of the patient's urethra from pinching, for preventing the leakage of urine from the patient's bladder, and for enhancing the contraction of rods after expansion, each of said rods having at least one cavity which in an assembled state of the probe has a symmetrical configuration and location with respect to a mating cavity of the second rod, so that in an assembled state of said probe both said cavities form an essentially closed cavity, said rotary camming means comprising a cam shaft with at least one cam having an outer surface with a maximum radius and a minimum radius and located in said closed cavity, said cam having a hole open towards said distal end of said probe, said hole having a maximum radius and a minimum radius, said rods having semicircular projections inserted into said hole, a radius of each of said semicircular projections being substantially equal to said minimum radius of said hole, so that when said cam rotates, said outer surface forces said rods to expand on one part of the revolution, while said hole forces said rods to contract on the remaining part of the revolution, said essentially closed cavity having an axial length greater than an axial length of said cam at least by a depth of insertion of said projections into said hole;

said closed cavity having an elliptical configuration, said outer surface and said hole of said cam having a substantially elliptical cross-sections corresponding to said elliptical configuration of said cavity, and said maximum and minimum radii of said outer surface and said hole being maximum and minimum radii of respective ellipses;

said means for protecting the mucosa of the patient's urethra from pinching, for preventing the leakage of urine from the patient's bladder, and for enhancing the contraction of rods after expansion comprising an outer shell of an elastic material which covers at least that part of said probe which is inserted into the patients urethra.

4. The vibratory device of claim 3 wherein said outer shell is removably put on onto said probe.

5. The vibratory device of claim 4 wherein said probe is disposable and molded from a plastic material.

6. The vibratory device of claim 4 wherein said resilient outer shell is attached to said probe at its proximal end.

7. The vibratory device of claim 4 wherein said resilient outer shell is made of a rubber film.

8. A vibratory device for treating voiding dysfunctions by inserting it into a patient's urinary tract and imparting vibrations to the urethral walls and the bladder neck, comprising:

a probe which has a distal end and a proximal end and consists of at least a first resilient rod and a second resilient rod said, rods being removably jointed at their distal ends;

a rotary drive having a housing and an output rotary shaft;

a rotary cam shaft with a distal end and a proximal end and with an elliptical cam on said distal end, said cam having a maximum radius and a minimum radius and an elliptical hole concentric with respect to said elliptical cam, said elliptical hole having a maximum radius and a minimum radius, each said rod having at least one opening of a semielliptical cross section so that, when said rods are laid one onto another said openings of semielliptical cross-section of each of said rods form a closed elliptical cavity, said cam being located in said closed cavity, said closed cavity having a minimum radius substantially equal to the minimum radius of said elliptical cam, said rods having semicircular projections inserted into said elliptical hole, each said projection having a radius substantially equal to said minimum radius of said hole, said proximal end of said cam shaft being connected to said output rotary shaft of said rotary drive, so that when said cam shaft rotates, said cam and said hole causes said rods to expand on one part of the revolution and to contract on the remaining part of the revolution, said cavity having an axial length greater than an axial length of said cam at least by a depth of insertion of said projections into said hole; and a resilient outer shell of an elastic material which covers at least that part of said probe which is inserted into the patient's urethra.

9. The vibratory device of claim 8 wherein said outer shell is removably put on onto said probe.

10. The vibratory device of claim 9 wherein said outer shell is made of a rubber film.

11. The vibratory device of claim 8 wherein said probe is made of a stainless steel.

12. The vibratory device of claim 8 wherein said probe is disposable and molded from a plastic material.

13. The vibratory device of claim 12 wherein said outer shell is attached to said probe at its proximal end.

14. The vibratory device of claim 8 wherein each said rod has a second cavity and said cam shaft has a second closed cavity formed by said cavities of said rods.

* * * * *